United States Patent [19]

Brown

[11] 4,253,216

[45] Mar. 3, 1981

[54] TAG AND NOTE CLIP

[76] Inventor: James Brown, 2330-10 Grand Ave., San Diego, Calif. 92101

[21] Appl. No.: 99,403

[22] Filed: Dec. 3, 1979

[51] Int. Cl.[3] ..... B42F 1/00; A44B 13/00

[52] U.S. Cl. ..... 24/67 AR; 24/67.3; 24/67.7; 24/84 R; 24/84 H

[58] Field of Search ..... 24/67 AR, 67.3, 67.7, 24/67.11, 84 R, 84 B, 84 H; 248/205 A

[56] References Cited

U.S. PATENT DOCUMENTS

| | | | |
|---|---|---|---|
| 743,547 | 11/1903 | Nix | 24/67.7 |
| 1,496,282 | 6/1924 | Taylor | 248/205 A |
| 2,486,593 | 11/1949 | Gardner | 248/205 A |
| 2,607,070 | 8/1952 | Wertz et al. | 24/67.7 |
| 2,732,602 | 1/1956 | Quimby | 24/84 R |
| 2,784,470 | 3/1957 | Watson | 24/67.11 |
| 2,846,134 | 8/1958 | Moubayed | 24/67 AR |
| 3,315,325 | 4/1967 | Cornelius | 24/67 AR |
| 3,399,429 | 9/1968 | Goodman | 24/67 AR |
| 3,591,013 | 7/1971 | Herrmann | 24/67 AR |
| 4,055,874 | 11/1977 | Brown | 24/67.3 |

FOREIGN PATENT DOCUMENTS

| | | | |
|---|---|---|---|
| 509345 | 11/1920 | France | 24/67.11 |
| 2381632 | 9/1978 | France | 24/67.7 |
| 1284997 | 8/1972 | United Kingdom | 24/84 |

*Primary Examiner*—Victor N. Sakran

*Attorney, Agent, or Firm*—Ralph S. Branscomb

[57] ABSTRACT

A removable clip for holding a slip of paper or the like identifying a person or object or describing the history or certain features of an object, the clip comprising a stationary portion having a planar projection and defining a deep bay, and a movable clamp attached to the stationary portion, there being a piece of tape or like adhesive coated sheet applied against the projection and extending into the bay so that the clip can be repeatedly adhered to and removed from the lapel of a suit, a shirt, a piece of equipment, or the like, without damaging the surface to which it is adhered and permitting the replacement of the adhesive sheet as the adhesive weakens so that the effectiveness of the clip is perpetual.

1 Claim, 6 Drawing Figures

TAG AND NOTE CLIP

BACKGROUND OF THE INVENTION

The idea for the invention was spawned in an office equipment repair environment wherein a sticky-backed label is generally applied to the equipment and the problem with the equipment, and perhaps the owner of the unit, is written on the label. These labels, however, have a tendency to stick so firmly to the piece of equipment that sometimes it may take as much time to remove the label as it does to repair the unit. In addition, it may be necessary to change the information on the unit as more is learned, which either requires a new label or scratching out and replacing the information on the old label, which may be difficult as it is most likely applied to the equipment on a curve or otherwise at an inconvenient orientation.

There have been developed clips which have a magnetic base and will of course adhere to thorough magnetic materials, but these suffer from the drawbacks of unworkability with plastic and other ferro-magnetic surfaces. Other clips utilizing an adhesive back have been provided, but these units, once stuck in place, cannot be removed. If, in fact, units of the last type were removed, after several usages the adhesive strength would have been neutralized and the clip would no longer be effective.

SUMMARY OF THE INVENTION

The present invention is a clip designed to resolve the above-stated problems in the prior art and represents a device which attaches by means of an adhesive sheet to any surface, clothing, ferro-magnetic, plastic or other metallic or synthetic, but which can very simply be used indefinitely by the ease with which the adhesive sheet, which can simply be taped, is replaceable after several usages which weaken the adhesive strength.

The unit includes a stationary member having a prong or other projection whose purpose it is to support the sticky side of the adhesive sheet and fall between the adhesive sheet and the surface to which it is adhered to facilitate removal of the clip as well as mounting the sheet. To this member is mounted a pivotal clamping member which serves both to hold the adhesive sheet against the projecting prong and also to permit the easy insertion and removal of a memo, identification tag, or other sheet of note paper beneath the clamping element while the clip is in use.

DETAILED DESCRIPTION OF THE PREFERRED EMBODIMENTS

Figure 6:
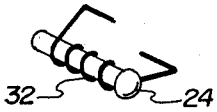
FIG. 6 is a retrospective view of the spring 32 utilized in the clip.

The clip is shown at 10 and has a lower stationary member 12 and an upper clamp member 14. The structure of the stationary member is such that it defines a generally planar projection 16 which, in FIG. 1, takes the form of a single prong. The rear portion of the projection 16 tapers outwardly into a broad, flat portion which is reverse bent at 18 to define a flat bay area 20. The stationary member 12 continues to define upturned ears 22 which mounts an axis pin 24 which in turn mounts downturned tab 26 of the clamp member 14. The clamp member, which ordinarily in the embodiment illustrated would be thin sheet metal as would be the stationary member, has a forwardly protruding clamp 28 having a jaw 30 which is biased downwardly by means of the spring 32 detailed in FIG. 6. The other end of the clamp member 14 is a finger lever 34 which, together with the reverse bent end of the stationary member 12, can be used to pinch the clip open and shut with the forefinger, although due to its mounting only one finger is ordinarily required.

Figure 1:
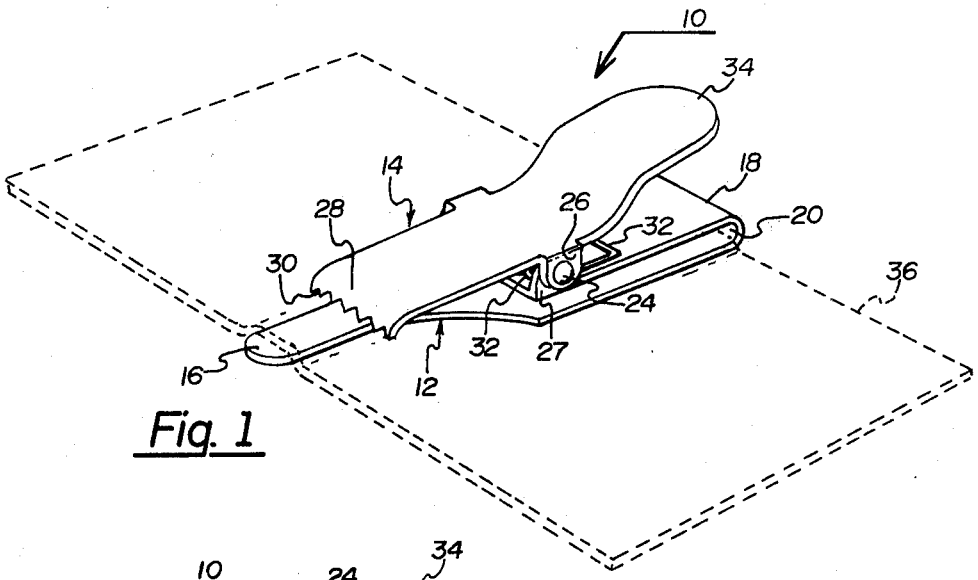
FIG. 1 is a perspective view of the clip showing the adhesive strip in place in phantom to reveal the remaining structure of the clip.
Figure 2:
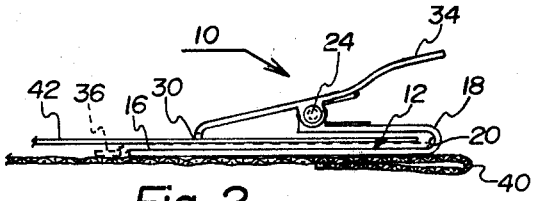
FIG. 2 is a side elevation view of the clip taking a section through the pocket material of a shirt.
Figure 5:
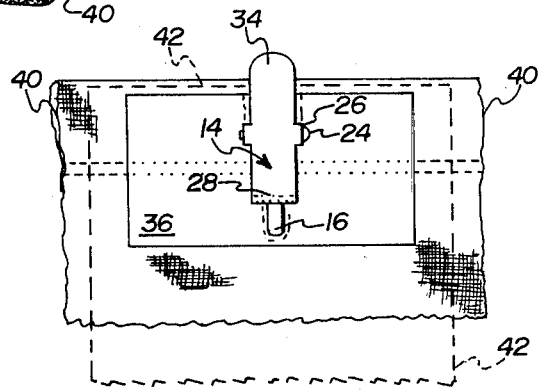
FIG. 5 is a front elevation view of the clip as oriented in FIG. 2 on a shirt.
Figure 4:
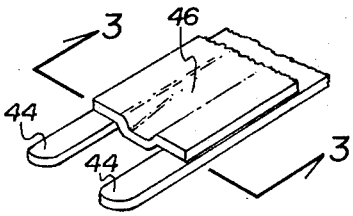
FIG. 4 is a perspective view of a detail of a modification of the clip utilizing two prongs with a simple protuberance on the clamp element.

Inserted preferably all the way into the bay 20 is a sheet of adhesive material indicated at 36 in phantom in FIGS. 1 and 2. The bottom of the sheet is covered with an adhesive 38 so that when the adhesive sheet is in place, as shown best in FIGS. 2 and 5, the unit can be pressed against a shirt pocket front 40 or adhered to a piece of office equipment or the like which requires a memorandum or note to be attached. The note is, of course, attached beneath the jaws 30 of the clamp and is shown at 42.

Because the projection 16 is positioned between the adhesive sheet and the surface to which it is to be adhered, removal of the entire clip is easily effected simply by pulling upwardly, or outwardly as the case may be. This enables the unit to be moved from one surface to another, and upon the approaching inefficacy of the adhesive on the sheet, it can very simply be replaced with another sheet.

The sheet 36 could be provided in specially shaped configurations, for example, horseshoe shaped pieces, or an ordinary piece of cellophane or masking tape. Conventional tape works quite effectively and of course is extremely cheap and a single roll could keep a number of clips operative for a long period of time.

Figure 3:
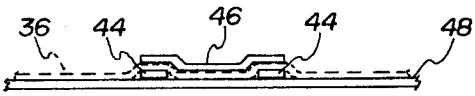
FIG. 3 is a sectional view taken along line 3—3 of FIG. 4.

A second embodiment of the invention is shown in FIG. 3 wherein in dual projections 44 defining spaced parallel tynes are utilized. In cooperation with these tynes the end of the clamp 28 of the device is provided with a downward protuberance 46 which fits snugly between the two tynes and projects downward somewhat to serve the dual function of holding the surface of the adhesive-coated sheet forward of the tynes to facilitate adhesion to the surface to which it is to be adhered, and also presses the sheet against the tynes 44 to insure proper pressure between the adhesive sheet and the tynes themselves.

Other embodiments of the invention are, of course, conceivable, including the concept of molding the two members 12 and 14 as a single plastic member of plastic having appropriate resilience to define a hinge-like center portion. Modified usages are also possible with the same basic clip. In FIG. 3, for example, the adhesive sheet 36 is adhered directly to the back of a name tag or identification tag 48 so that the clip proper may be used to attach the tag to a shirt pocket or lapel.

Also, other embodiments of the stationary member 12 are conceivable, including a circular projection, more than two tynes, a projection 16 which is flexible to accommodate a curved surface, and an upper clamp member 14 utilizing two somewhat independent forward projections, one of which falls against the adhesive sheet as does the protuberance 46, the other being above this protuberance and defining a semi-independent, possibly separately biased, projection having a jaw such as jaw 30 thereon.

Other variations and modifications within the scope of the amended claims are of course contemplated to be within the range of protection defined by this patent.

What is claimed is:

1. A removable note clip comprising:

(a) a non-pivoting stationary member having at least one generally planar projecting stationary prong;

(b) a replaceable sheet having adhesive on one side thereof and being pressed with adhesive against said prong to define an adhering side and non-adhesive side of said clip and non-pivoting member;

(c) a clasp member being pivotally mounted on said non-pivotal member and having a clamping prong pivotal from a position clear of said stationary prong and said sheet to a position contacting said sheet, said clasp member including pressure-applying member, and including means biasing said clamping prong against said sheet, whereby said clip can be releasably adhered to a surface with a note engaged between said clamping prong said sheet and;

(d) said stationary member defining a deep bay extending beyond the pivotal connection between said member and said sheet extends fully into said bay to raise the center of adhesion relative to the center of gravity of said clip to improve the stability thereof when same is adhered with the prong downwardly extended.

* * * * *